United States Patent [19]

Aver, Jr. et al.

[11] Patent Number: 4,711,418

[45] Date of Patent: Dec. 8, 1987

[54] RADIO BASED RAILWAY SIGNALING AND TRAFFIC CONTROL SYSTEM

[75] Inventors: John H. Aver, Jr., Fairport; William A. Petit, Spencerport, both of N.Y.

[73] Assignee: General Signal Corporation, Stamford, Conn.

[21] Appl. No.: 849,614

[22] Filed: Apr. 8, 1986

[51] Int. Cl.[4] ..... B61L 3/02

[52] U.S. Cl. ..... 246/5; 246/187 B

[58] Field of Search ..... 246/187 B, 187 C, 3, 246/122 R, 4, 182 C, 5, 167 R, 270 A; 340/991, 992, 993, 994; 371/33

[56] References Cited

U.S. PATENT DOCUMENTS

| | | | |
|---|---|---|---|
| 2,138,878 | 12/1938 | Phinney | 246/270 A |
| 3,112,908 | 12/1963 | Hailes | 246/3 |
| 3,250,914 | 5/1966 | Reich | 246/5 |
| 3,676,669 | 7/1972 | Jauquet | 246/187 B |
| 3,754,211 | 8/1973 | Rocher et al. | 371/33 |
| 3,805,056 | 4/1974 | Birkin | 246/187 B |

FOREIGN PATENT DOCUMENTS

| | | | |
|---|---|---|---|
| 1293585 | 10/1972 | United Kingdom | 246/187 B |

OTHER PUBLICATIONS

"Location Identification and Control", C & S Division, AAR Committee Reports and Technical Papers 1933, Trainguard, Union Switch and Signal, Bulletin No. 392, Oct. 1983.

*Primary Examiner*—Gerald L. Brigance

*Assistant Examiner*—Alvin Oberley

*Attorney, Agent, or Firm*—Martin LuKacher; Ronald Reichman

[57] ABSTRACT

A railway signaling and traffic control system which minimizes the wayside equipment and eliminates the pole lines which carry power and signals along the right-of-way using instead the radio channel between the trains and the central office. Each train communicates with devices, such as passive beacons, which provide zone boundary messages. These devices provide secure messages to a control unit containing a microprocessor which responds to zone boundary messages and provides location information to the central office via radio when the train enters and leaves each zone. The central office has an input and communication processor and a vital processor. The vital processor converts route requests and the zone occupancy messages which are received by the input and communications processor into messages representing the signal aspects (the maximum speed at which the train can proceed), not only for the zone currently occupied, but also for the zone next ahead. The train control unit stores both aspects and displays the aspect for the currently occupied zone. When the train crosses a zone boundary and enters the next zone the new aspect is displayed. The distance for which the aspect remains valid is restricted by the zone boundary beacons and cross-checked by the locomotive odometer. Train stops, which were previously used to limit the distance an aspect is valid, are avoided thereby simplifying the signaling system.

19 Claims, 7 Drawing Figures

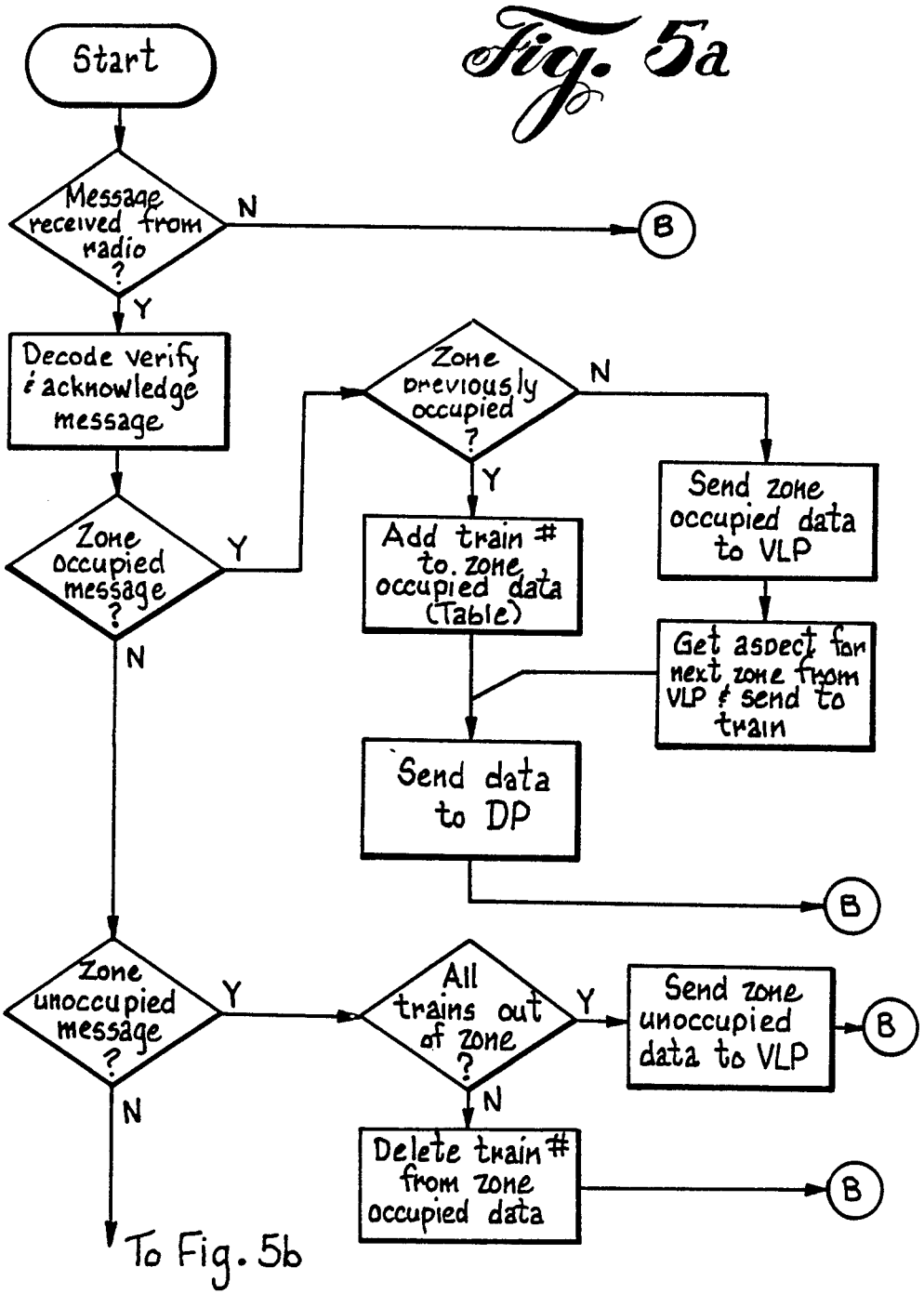
Fig. 5a
Start
Message received from radio ?
N
B
Y
Decode verify & acknowledge message
Zone occupied message ?
Y
N
Zone previously occupied ?
N
Y
Add train # to zone occupied data (Table)
Send zone occupied data to VLP
Get aspect for next zone from VLP & send to train
Send data to DP
B
Zone unoccupied message ?
Y
N
All trains out of zone ?
Y
N
Send zone unoccupied data to VLP
B
Delete train # from zone occupied data
B
To Fig. 5b

RADIO BASED RAILWAY SIGNALING AND TRAFFIC CONTROL SYSTEM

DESCRIPTION

The present invention relates to railway signaling and traffic control systems, and particularly to a railway signaling and traffic control system wherein information is conveyed between the trains and the central office by radio signals.

The invention is especially suitable for providing a radio based railway signaling and traffic control system which utilizes the existing voice radio channel with which the trains and central office are equipped. Communication may also be provided over separate dedicated radio channels or by way of satellites in orbit above the Earth.

It is the principal feature of this invention to provide an improved railway signaling and control system that uses radio communication and position locating systems rather than the track circuits for position locating and wayside logic (relay or electronic) for performing vital logic in response to route requests and the location of the trains. The wayside equipment is minimized and the pole lines for communications and power transmission can be eliminated thereby minimizing the installation and maintenance cost of the system.

Radio based railway signaling systems have heretofor been proposed. See Hailes, U.S. Pat. No. 3,112,908 issued Dec. 3, 1963 and Reich, U.S. Pat. No. 3,250,914 issued May 10, 1966. Such systems require complex installations along the wayside. Specifically wayside equipment which provides train stops are required along the right-of-way at which trains must stop unless authority to proceed signals are received and acknowledged by the trains. The present invention eliminates train stops and enables the efficient flow of traffic with safety and fuel economy.

A further object of the invention is to provide an improved radio based railway signaling and traffic control system which is capable of utilizing equipment which need not be supplied with operating power to indicate the location of the trains with respect to boundaries of zones along the tracks, such as passive beacon transponders, or space satellite locating equipment typically using triangulation principles. Such communications and location systems make signalization of railway lines carrying low traffic volumes economically viable. The use of beacons has the additional advantage that each beacon's specific message can only be received in the immediate vicinity of the beacon thereby automatically providing additional location determining security. A beacon also has better locating precision than typical satellite systems.

Another feature of the present invention is to provide a railway signaling and traffic control system for the control of rolling maintenance equipment which does not shunt the track and does not enable conventional track circuits to provide location information. Such maintenance equipment may for example be high-railer trucks.

Another object of the invention is to provide an improved radio based railway signaling and traffic control system wherein messages are communicated as digital data in packets, intermittently when needed, such as only when the train has acquired new information for example as to its entering the next zone ahead. In the event of contentions or collisions between simultaneous transmissions, the signals may be retransmitted in the absence of an acknowledgement from the train to which the message is addressed or from the central office, as the case may be.

A still further object of the invention is to provide an improved radio based railway signaling and control system which is adapted for use with existing centralized traffic control systems at the central offices of the railway. Such systems utilize route requests and occupancy information and provide the commands and control messages to the trains and other equipment, such as track switches, slide fences and highway crossings; the messages being transmitted as radio signals, digitally coded and addressed to the trains, switches and other traffic control equipment. These messages are adapted to be generated by vital processing techniques; for example as described in following U.S. Pat Nos.: Smith, Hoelscher and Petit, 4,498,650; Sibley, 4,181,842; Sibley, 4,090,173 and Murray, 3,976,272.

It is a still further object of the present invention to provide an improved radio based railway signaling and traffic control system which is adapted to provide additional messages as to train health, and which represents whether such parameters as oil pressure, temperature, and fuel level are out of tolerance, and also messages from hotbox sensors and end of train detectors. Emergency conditions as to any train can then be detected at the central office and traffic can be controlled taking these conditions into account together with train location and zone occupancy information. The central office can then transmit messages to the trains from which cab signal aspects are displayed which will permit fuel efficient operation of the railway.

Briefly described, a railway signaling and traffic control system embodying the invention, in which the use of train stop apparatus can be avoided, utilizes radio communication means for transmitting first signals from trains traveling along the track which are received at a central office and second radio signals which are transmitted from the central office to the trains. Means are provided for transmitting the first signals with information which represents the location of each of the trains with respect to the boundaries of successive zones along the tracks and identifying each such train. Means are also provided for transmitting to identify the trains the second signals with information representing a signal aspect for the zone occupied by such trains and for the next zone. Means on each train are provided for displaying the aspect for the zone which is occupied by the train and for storing the information for the signal aspect for the next zone. Each train has means of automatically displaying the stored signal aspect for the next zone ahead when it enters the next zone. Each train also has means for automatically displaying a signal aspect for the next zone more restrictive than the signal aspect displayed by the displaying means in the train for the preceding occupying zone in the event that the signal aspect for the next zone is not being stored when the train enters the next zone. The system therefore avoids the need for acknowledgement at the train stop locations and permits the continuous flow of traffic in accordance with fuel efficient operating strategies.

The foregoing and other features, objects, and advantages of the invention as well as a presently preferred embodiment thereof, will become more apparent from a reading of the following description in connection with the accompanying drawings in which.

Figure 1:
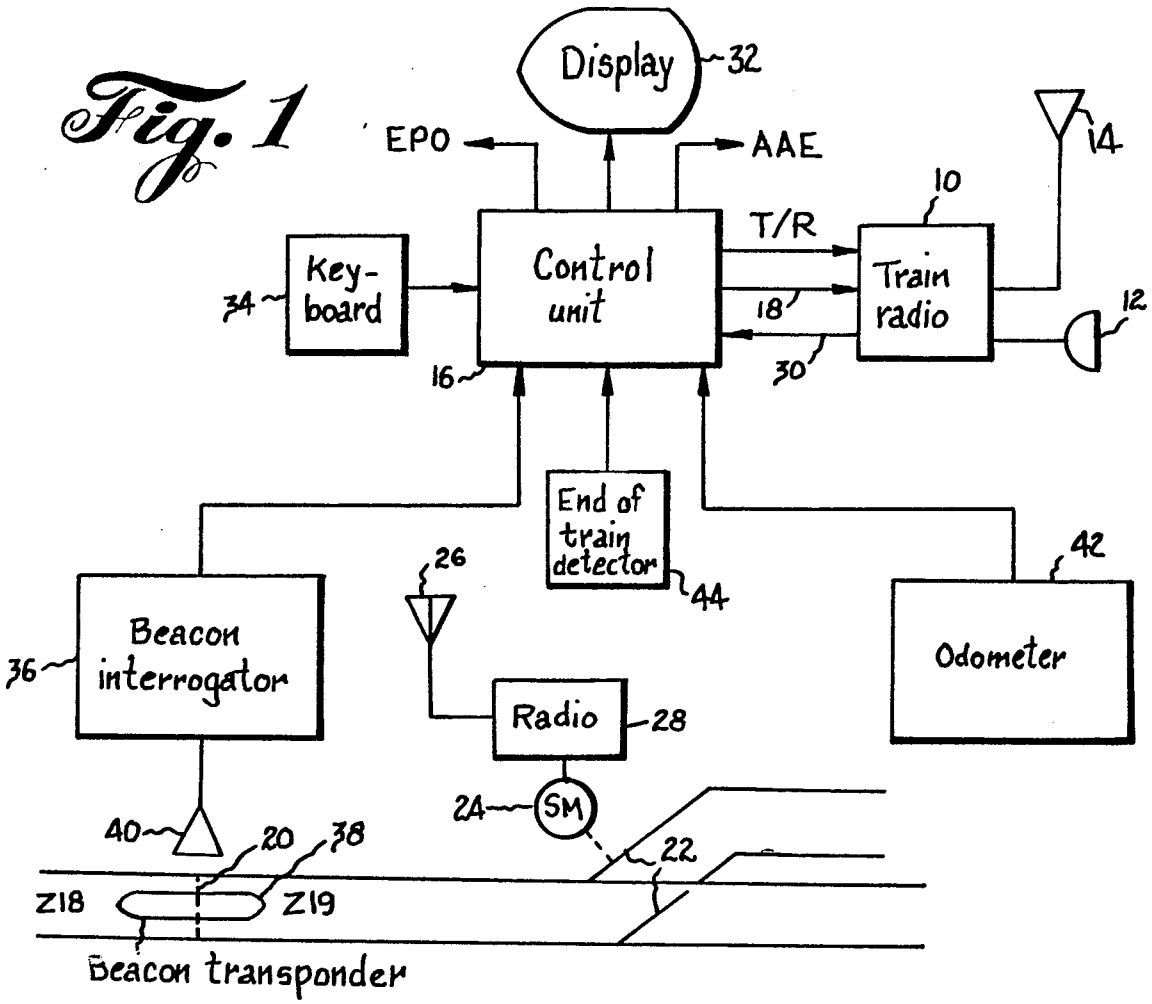
FIG. 1 is a block diagram of the portion of the system provided by the invention with which each train is equipped and also showing beacon transponders and equipment associaed with a typical track switch.

Referring first to FIG. 1 there is shown the equipment of the improved radio based railway signaling and control system which is mounted on board a train. The equipment may principally be located in the locomotive cab. This equipment includes the train radio 10, which may be the two-way radio used for voice communications with the locomotive engineer. A microphone/-loud speaker transducer 12 is connected to the input of the radio for voice communication over the radio link with the central office. The radio signals may be in the VHF range, as is conventional. The radio frequency signals are transmitted and received on an antenna 14 connected to the radio 10. The radio transmits the messages as to the location of the train and receives control messages as to the signal aspect and other traffic control commands from the central office.

Instead of a radio which provides terrestrial communications, the communication link may be by way of a satellite. For terrestrial communications the radio link may be through base stations which are scattered over the railroad territory and from the base stations to the central office. The radio 10 is controlled by a control unit 16 which contains a microprocessor based computer of fail-safe design. A transmit receive (T/R) control line to the radio opens the transmit channel whenever messages are to be transmitted to the central office over a line 18 from the control unit. These messages are preferably digital messages which may be frequency shift keyed (FSK) tones. Each message may for example be one-half second in duration and transmitted intermittently only when there is a change in the train location such as the entering of a new zone along the track.

The tracks of a typical line are shown in FIG. 1 as is the boundary 20 between two adjacent zones indicated as Z18 and Z19. A siding is connected to the Z19 tracks by a track switch 22 operated by a switch machine 24. This switch machine is controlled from the central office by a radio communication link including an antenna 26 and a radio 28, the operation of which will be described in greater detail hereinafter.

The signals received by the radio 10 from the central office are connected by way of a line 30 from the radio to the control unit 16. The radio is normally conditioned into its receive mode and is switched to transmit only when new information is to be communicated to the central office or when the locomotive is responding to a message from the central office.

The messages both transmitted to the central office and received therefrom are digital messages which are coded in accordance with a secure and error correcting code. A typical message format which may be sent from the central office to the locomotive as a control message indicating the signaling aspect for the locomotive or from the locomotive to the central office as an acknowledgement message is as follows:

nnnnnnaaaazzzzzzzzzzzzttttttttttcccccccccccccccc-
cccccccccc cccccccccccccccccccccc The message has five fields each with a different number of bits. The bits are transmitted serially. The bits indicated by the letters "n" indicate the type of message. There are various message types which may be sent. These may consist of (1) the speed aspect; (2) emergency stop; (3) voice communication request; (4) 0.K. to unlock a hand-operated track switch; (5) distance to the next zone boundary; (6) the condition of a powered track switch (either normal or reverse); and (7) that this is a verification or acknowledgement message.

The field made up of four bits indicated by the "a" identifies the zone aspect. The twelve bit field identified by "z" is the zone identification. The field indicated by the ten bits identified by "t" is the train identification number. The remaining forty-nine bits identified by "c" are check bits which constitute a forty-nine bit check word for securing the message and making sure that it is correct. The twelve bit zone identification is a unique value that specifies the entrance to each zone. Eastbound zone identifications can be specified by clearing the least significant bit, making an even zone identification field, and westbound zone identifications are specified by setting the least significant bit thereby making the identification field odd. With twelve bits there can be 2,048 zones each with a different identification at the easterly and westerly end thereof in the signaled territory.

The ten bit train identification provides a set of unique values, with one for every train in the system. The system allows train identifications of the value up to 1,023 to be set. Thus over 1,000 trains in any territory can be controlled.

The zone signaling aspect may have at least seven values. Value 00 indicates that the train is not in the territory controlled by the signaling system. A value of 01 indicates a stop which is not absolute but commands the train to stop and then proceed slowly. Value 02 can indicate to the train to take the siding. Value 03 can indicate to the locomotive engineer to approach at slow speed. Value 04 can indicate a medium speed approach. Value 05 can indicate that the train can proceed at high speed because the zone is clear. Value 06 can indicate an absolute stop. These signaling aspects are displayed, for example, on a display with either alphanumeric characters, code symbols or lamps of different color or color combinations, on a display 32 which is driven by the control unit 16.

The messages which are sent from the central office to the train are serial digital signals, such as FSK tones. The types of messages which are transmitted may include the following types of messages: (1) the speed aspect signal for identified trains; (2) emergency stop; (3) a voice communication request; (4) a command to unlock a track switch; (5) the distance to the next zone boundary to a train just entering a zone; (6) a message to a powered switch machine to throw the switch from normal to reverse or vice versa; and (7) a verification or acknowledged message which may be the same message which is received except for its most significant bit.

A keyboard 34 is connected to an input of the microprocessor based control unit 16 for entering messages which are to be transmitted to the central office such as the messages identified above and also the train identification code, train length (number of cars plus locomotives) and the direction of travel of the train. It will be noted that the zone occupied and unoccupied messages are sent automatically by the control unit in response to messages from a beacon interrogator 36. This interrogator cooperates with passive beacon transponders 38 at each zone boundary, such as shown at 20 in FIG. 1. The beacon transponders 38 and the beacon interrogators may be similar to transponder and interrogator devices of the Identifier TM automatic vehicle identification system which is commercially available from General Railway Signal Company, Rochester, N.Y. 14692, U.S.A. The beacon transponders 38 receive power necessary to their operation from the beacon interrogator 36. Each beacon transponder provides a secure message which may be in the form of a pulse modulated carrier; the message may have three fields and be in the following format:

zzzznnnnddd

Each letter corresponds to 1 of 40 alphanumeric characters. The characters indicated by the "z" identify the zone entered by the train. The characters identified by the "n" identify the next ahead zone. The characters identified by "d" identify the distance to the next zone boundary. Additional check characters can be added if desired. The same rules for identifying zones may be used as explained in connection with the aspect messages transmitted from the central office to the trains with even numbers representing eastbound zones and odd numbers representing westbound zones.

The beacon interrogator 36 contains a microprocessor which checks the received data for errors and passes the received data which represents the location of the train with respect to the boundaries of the zones to the control unit. Further information respecting the design of the beacon interrogator 36 and the passive beacon transponders 38 may be obtained from literature published by General Railway Signal Company. Briefly, the interrogator contains a UHF transmitter that generates a pulse modulated carrier, for example at 906 MHz. This carrier is radiated towards the transponder 38 by a directional antenna 40. The interrogation pulses are received by the transponder 38 and are passed through a tuned circuit which insures that the transponder will respond only to the signal generated by the interrogator 36. Within the transponder 38, the carrier signal is rectified to provide a DC power source for the generation of a modulation signal for a harmonic generator which transmits its programmed code message back to the interrogator in the form of a higher frequency amplitude modulated carrier signal (for example at 1812 MHz). When the return signal is detected by the interrogator 36, the microprocessor therein switches the transmitter to a steady carrier output signal to provide a sustained power source for the transponder 38. The interrogator has a receiver which detects the return signal and applies it to a decoder which formats the coded message into digital data signals and inputs these data signals to the microprocessor contained in the interrogator 36. The microprocessor checks the received data for errors and applies the received data as an input to the microprocessor of the control unit 16.

The train borne equipment includes an odometer 42 which measures the distance traveled by the train and is reset each time the train enters a new zone. The signals from the odometer are utilized to check the proper performance of the beacon interrogator 36 and the beacon transponder 38. The information as to the distance to the boundary of the next zone ahead is provided by the beacon interrogator 36 to the control unit and is available for comparison with the distance signal from the odometer so as to verify whether or not the next beacon has been missed. Missing of the next beacon can be taken as an indication that the authority to proceed represented by the displayed signal aspect for the zone is exceeded. Then, the system is operative to change the aspect to the next more restrictive aspect so as to insure safe and continuous operation of the trains without the need for train stops at the zone boundaries.

The train may also be equipped with an end of train detector 44. Such detectors are commercially available and may include sensors of the brake pressure at the rear end of the train. When the pressure measurements indicate lack of train integrity, a radio at the end of the train stops transmitting a signal along the train to a receiver in the locomotive (which provides an output indicating the lack of train integrity). This output automatically actuates the control unit 16 to generate an emergency message which is transmitted by the radio 10 to the central office. The emergency message may also be indicated on the display 32.

While the beacon interrogator 36 and transponder 38 system is presently preferred, other means may be used to indicate the location of the trains with respect to the zone boundaries. Satellite locating systems may be use. One such system is the radio determined satellite system (RDSS) which involves transponders permanently mounted at locations along the track and a satellite transponder on the train. Reference signals from the permanently mounted transponders are compared with signals from the train transponder when precise locations are necessary. The satellite interrogates the transponder on the train and the reference transponders and provides information from which the location of the trains may be determined at the central office. Messages as to the location of the train with respect to the zone boundaries can then be transmitted from the central office to the train carried equipment of the railway signaling and traffic control system.

Figure 2:
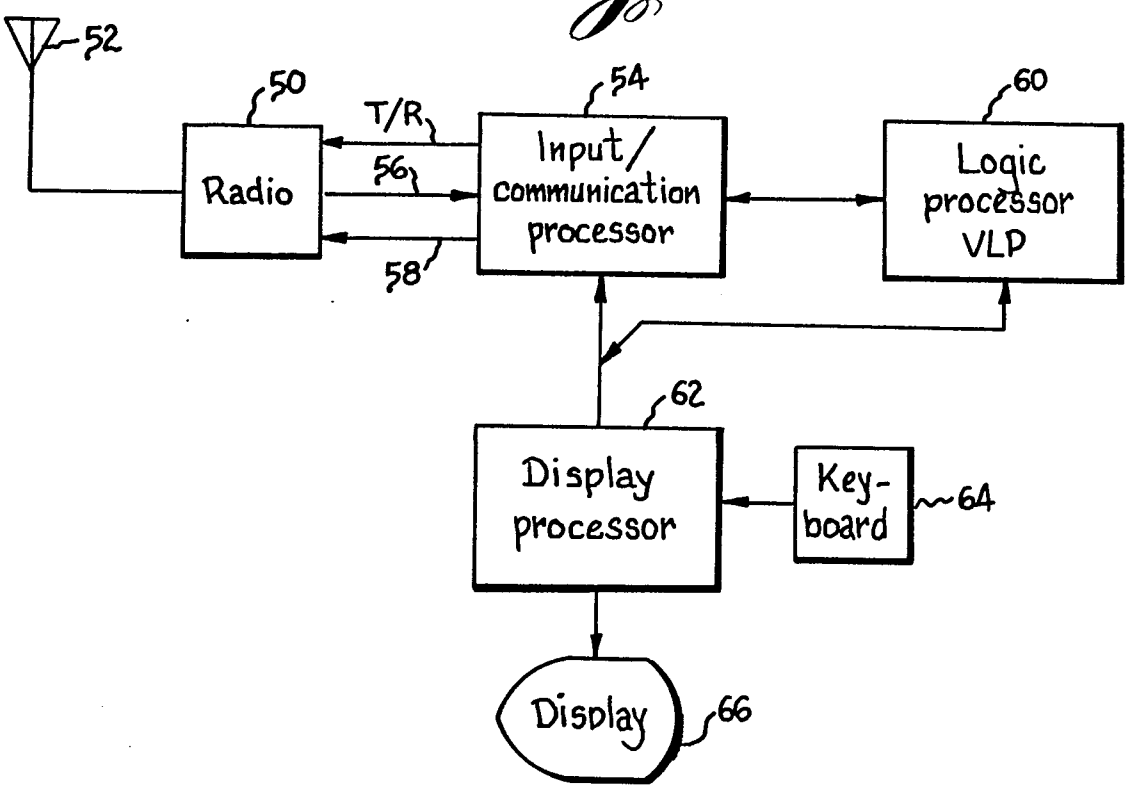
FIG. 2 is a block diagram of the portion of the system which is located at the central office.

Referring to FIG. 2 there is shown the central office components of the system. These components consist of a two-way radio 50 which receives and transmits signals via an antenna 52. The radio is connected to an input/-communications processor 54. This processor 54 contains a microprocessor computer chip and associated memory as well as input circuits for converting the FSK tones applied to it by the radio 50 over an input line 56. These signals are converted into digital signals. The validity of the signals is checked using the check bits of the message and acknowledgement messages are inputted to the radio over a radio input line 58. A control line from the processor 54 to the radio normally commands the radio 50 to its receive mode and switches the radio to transmit when an output message appears on the input line 58 to the radio 50. The input processor is also programmed to format the messages with the check bits and to retry transmissions on a random time delay basis when acknowledgements are not received from the train to which the message is addressed. The input processor converts zone identification data in the messages received from the trains and stores zone occupied information on a table in memory.

The central office components include a vital logic processor 60 and a display processor 62. The display processor 62 is also connected to the vital logic processor 60.

A keyboard 64 is available to the dispatcher at the central office for entering messages; for example, for the control of track switches and emergency conditions. Another message which may be inputted by the dispatcher through the keyboard is a request to an identified train to enter into voice communication with the dispatcher. Such a request goes directly to the processor 54 and is converted into the message which is transmitted by the radio 50 to the trains. The vital logic processor 60 receives these dispatcher messages which are inputted on the keyboard 64. The zone occupied data provides the vital logic processor with information as to where all of the trains are located (the data as to which zones are occupied and by which trains). Route requests are also inputted into the vital logic processor. The vital logic processor may be a General Railway Signal Company VPI TM type computer which is programmed to carry out vital logic processes and to solve Boolean equations so as to generate the signal aspects for each train. Inasmuch as these are the same logical processes as are presently solved by wayside equipment which utilizes track circuits and are well known in the railway signaling art, they are not described in detail herein.

A display 66, such as a CRT (Cathode Ray Tube) display or a mimic board is driven by the display processor 62 so that the dispatcher may observe the location of the trains along the tracks.

Where two trains are in the same zone, the input processor 54 sends a message to the vital logic processor (for example the same 32 bit message which indicates the occupied zone less the check bits) while storing in the table in its memory data that another train is occupying the zone. When the first train moves out of the zone, further data is not sent to the vital logic processor. However, when the last train moves out of the zone, the zone unoccupied information is forwarded to the vital processor 60. This simplifies the program and expedites the generation of the signal aspects for the trains in the vital processor.

Figure 3A:
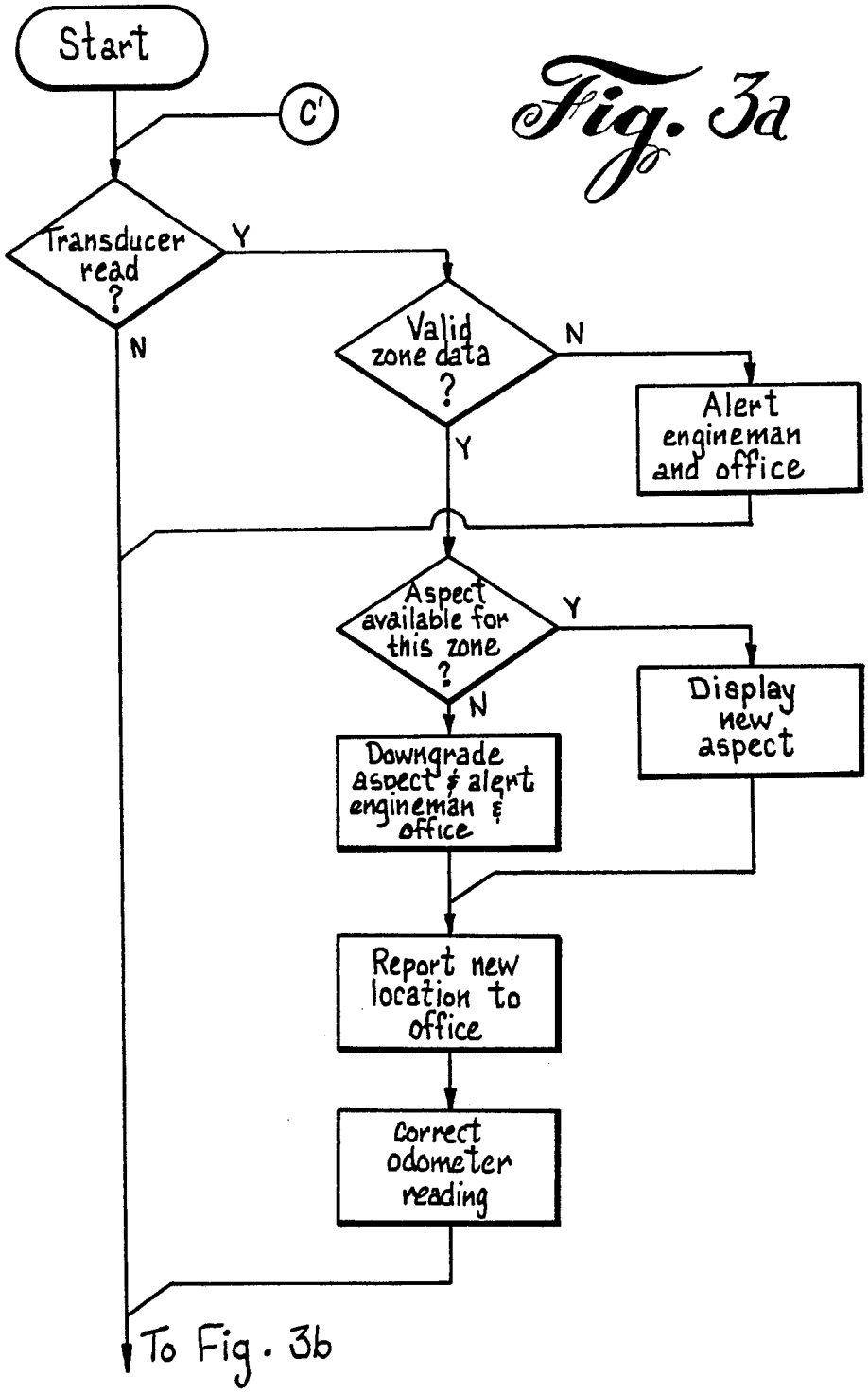
FIGS. 3*a, b,* 4 and 5*a, b* are flow charts describing the program utilized in the microprocessor of the control unit shown in FIG. 1 and the input/communication processor in FIG. 2.

The programming of the computer in the control unit 16 of the train borne equipment will be apparent from the flow charts shown in FIGS 3*a*, *b* and 4. The first program task starts when a beacon transponder 38 is read by the interrogator 36 and the data is read into the control unit computer. The computer determines if the zone data is valid using the check sum characters. If the data is invalid but still recognized as beacon transponder data, the locomotive engineman or engineer is alerted and a message is generated and transmitted by way of the train radio 10 to the central office.

Valid zone data means that the train has entered the new zone. The control unit memory has stored therein two aspects for the zone previously occupied by train, for example zone 18 in FIG. 1 and for the next zone (zone 19) in FIG. 1. If the signal aspect for the new zone is available, it is displayed on the display 32 and the aspect for the preceding zone is discarded. In the event that no aspect is stored and is not available, the previous aspect is downgraded; for example, from a proceed at full speed or clear aspect to a medium speed aspect. A message is also generated as to the unavailability of the aspect for the next zone ahead and is transmitted to the central office. The engineer is also alerted. He may then wish to enter into voice communication with the central office dispatcher.

After the aspect is changed, the control unit generates a message indicating that the next zone is occupied by the train and that message is transmitted by way of the train radio 10 to the central office.

Continuing with the program flow, the program proceeds to seek messages which may have been received from the central office by the radio 10 and which are awaiting action. Such messages which can come from the central office have been discussed above. If any such messages are received, they are decoded verified by the use of the check bits of their error correcting codes and an acknowledgement message is generated and transmitted to the central office. The message is processed in the control unit computer and displayed on the display 32.

After the processing of any messages which may have been received or if no messages have been received, the program proceeds to determine whether or not there has been a missed transponder. The tracks may have signs visible to the engineer at each zone boundary. If a transponder is not read, as indicated by a beep or an audio alarm associated with the display, a voice message may be generated and the central office alerted. It may be noted that each time the display changes, as when a new aspect is displayed or a message is displayed an audible alarm (a beep or beeps) which may vary depending upon the type of message, will be sounded.

At the beginning of each run the train enters information as to its length (the number of cars plus locomotives). The odometer measurement is checked after valid transponder data has been read indicating that the train has entered the next zone ahead. Thereafter, when the odometer reading indicates the length of the train has moved past the zone boundary, a message is generated indicating that the previous zone or block of the tracks is now unoccupied by the train. This zone unoccupied message is transmitted to the central office via the train radio.

The odometer is also used to indicate whether the train movement authority has been exceeded. Train movement authority is exceeded if the train has moved a distance greater than the distance between successive zone boundaries without reading the beacon transponder at the successive zone boundary. The distance input from the odometer is compared with the data representing the distance from the previous zone boundary which is contained in the message from the beacon transponder at the preceding zone boundary. If the odometer data exceeds the distane data from the preceding transponder, the signal aspect is automatically downgraded and a message is generated to alert the office and the engineer. This message may be presented on the display 32. The acknowledgement messages from the central office are then correlated with the messages transmitted from the train to the central office. The acknowledgement messages should be the same as the transmitted messages except for the most significant bit. In the event that the verification of the receipt of an acknowledgement message is not indicated, the message which has not been acknowledged, which message has been retained in the memory of the control unit computer, is repeated and acknowledgements are awaited. Each repetition of the same message is with a different time delay so as to minimize the possibility of collisions between messages from different trains. This step is desirable when the same frequency is used for radio signaling between the trains and the central office and vice versa.

The program next proceeds between the connectors A and A'. The odometer is then used to compute the speed of the train; for example by measuring the distance traveled over a specified time interval (e.g. one second). If the speed of the train exceeds the aspect authority, an automatic aspect exceeded alarm signal is generated by the control unit 16. This alarm is labeled AAE and may be used to apply the brakes of the train.

Then, any other messages which have not been transmitted are generated. Such messages may for example be as described above and include requests to unlock track switches, to switch a track switch to its normal position or as to the health status of the train. The messages are retransmitted, if not acknowledged by the central office.

The train may be equipped with means for operating unpowered electric switch machines. When a message to unlock a switch of such machine is received, the control unit provides a EPO command to actuate an energization circuit to an inductive coupler which cooperates with another inductive coupler, forming a transformer, to couple AC power to energize the switch machine.

In the event that the switch machine is already powered, such as the switch machine 24 shown in FIG. 1, then the central office transmits commands to the radio 28 which commands the switch machine 24 to assume its normal or reverse position.

Finally, the output of the end of train detector 44 is checked. If the train is intact the program jumps back to the start and repeats. If the end of train detector indicates that the train is not intact, an appropriate emergency message is generated and transmitted to the central office. The engineer is also alerted by a special message on the display 32.

Figure 5B:
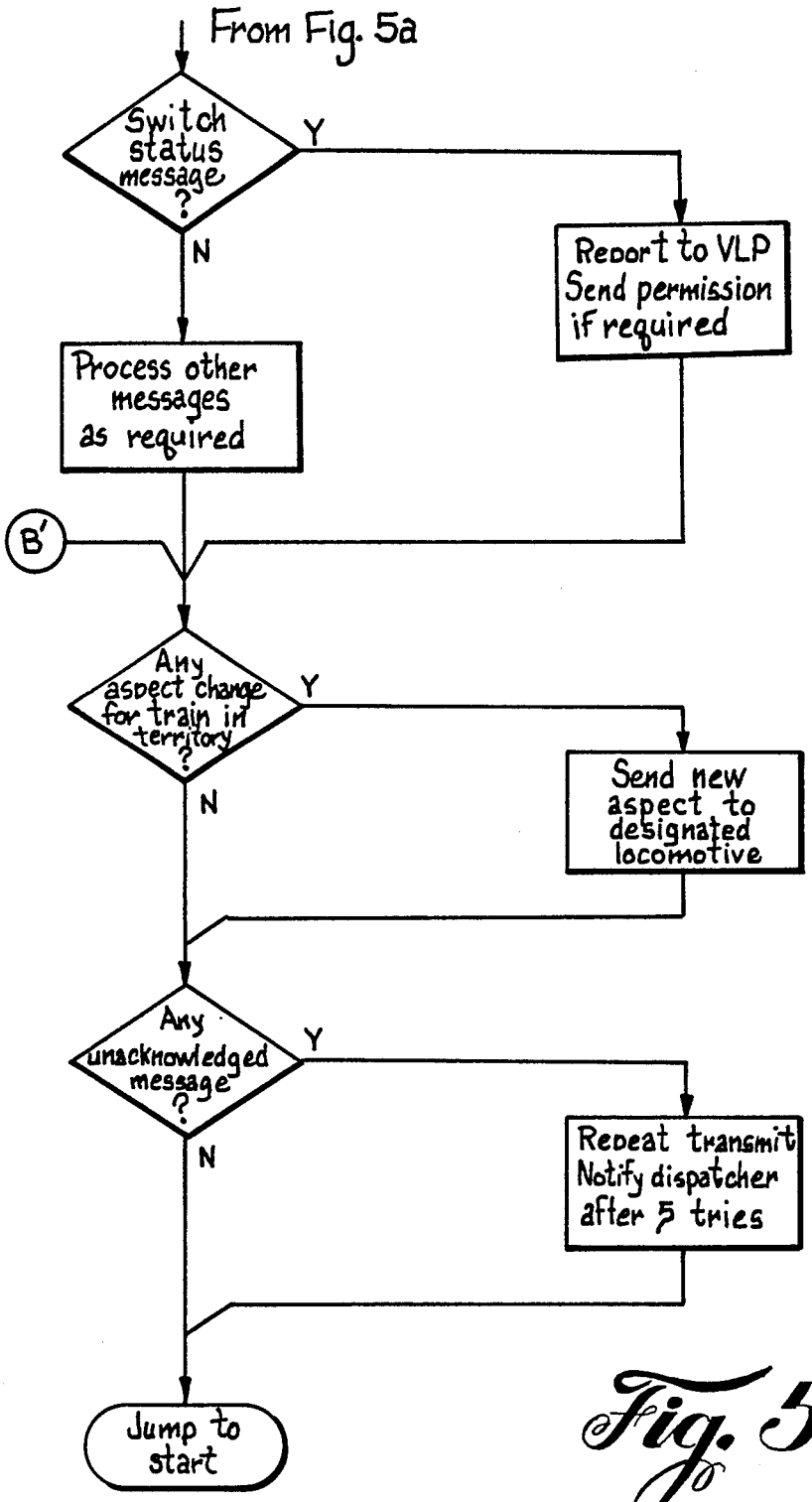

The programming of the input and communications processor 54 of the central office will be apparent from the flow chart shown in FIGS. 5*a, b*. The input and communication process 54 cooperates with the vital logic processor 60 and receives data as to the signal aspects for each train as mentioned above.

Figure 3B:
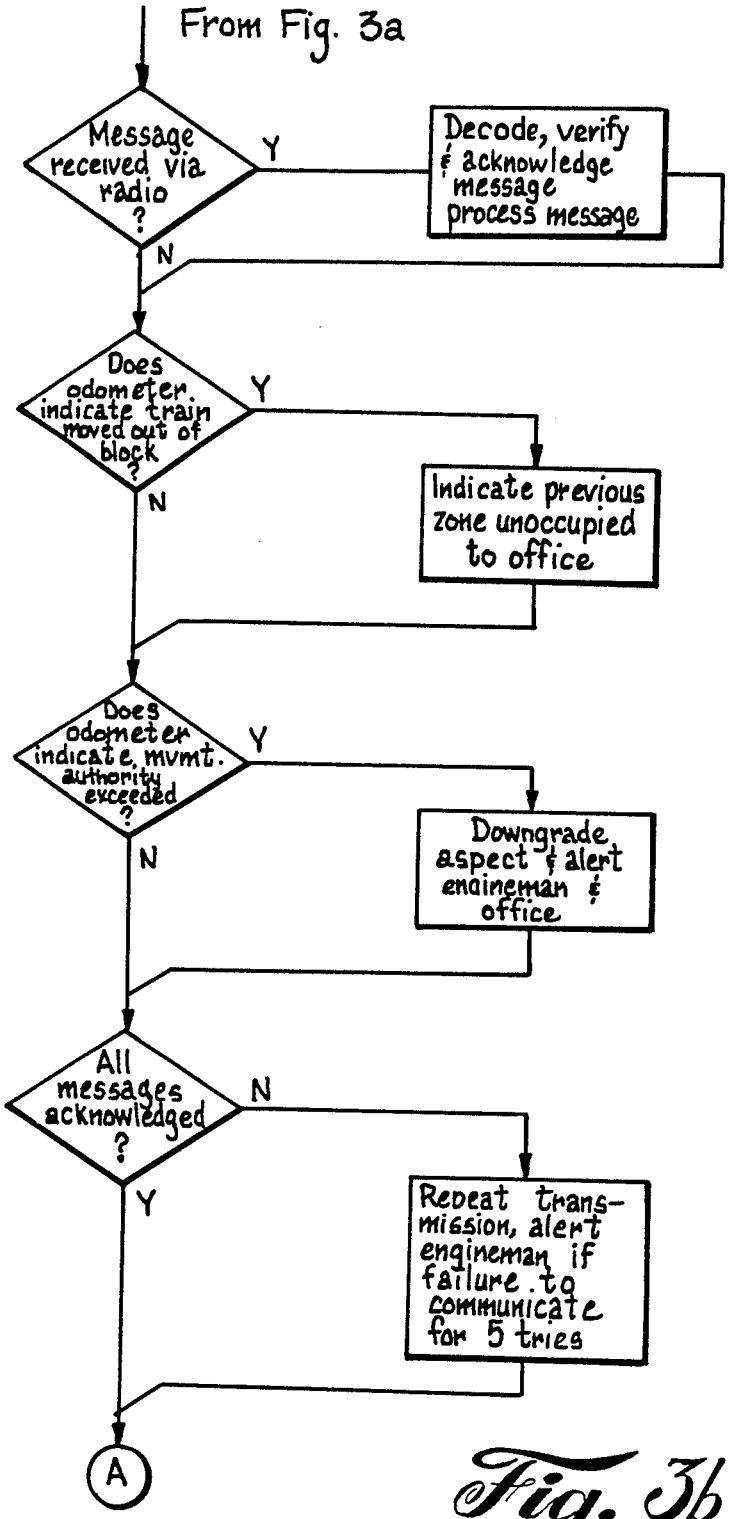
Figure 4:
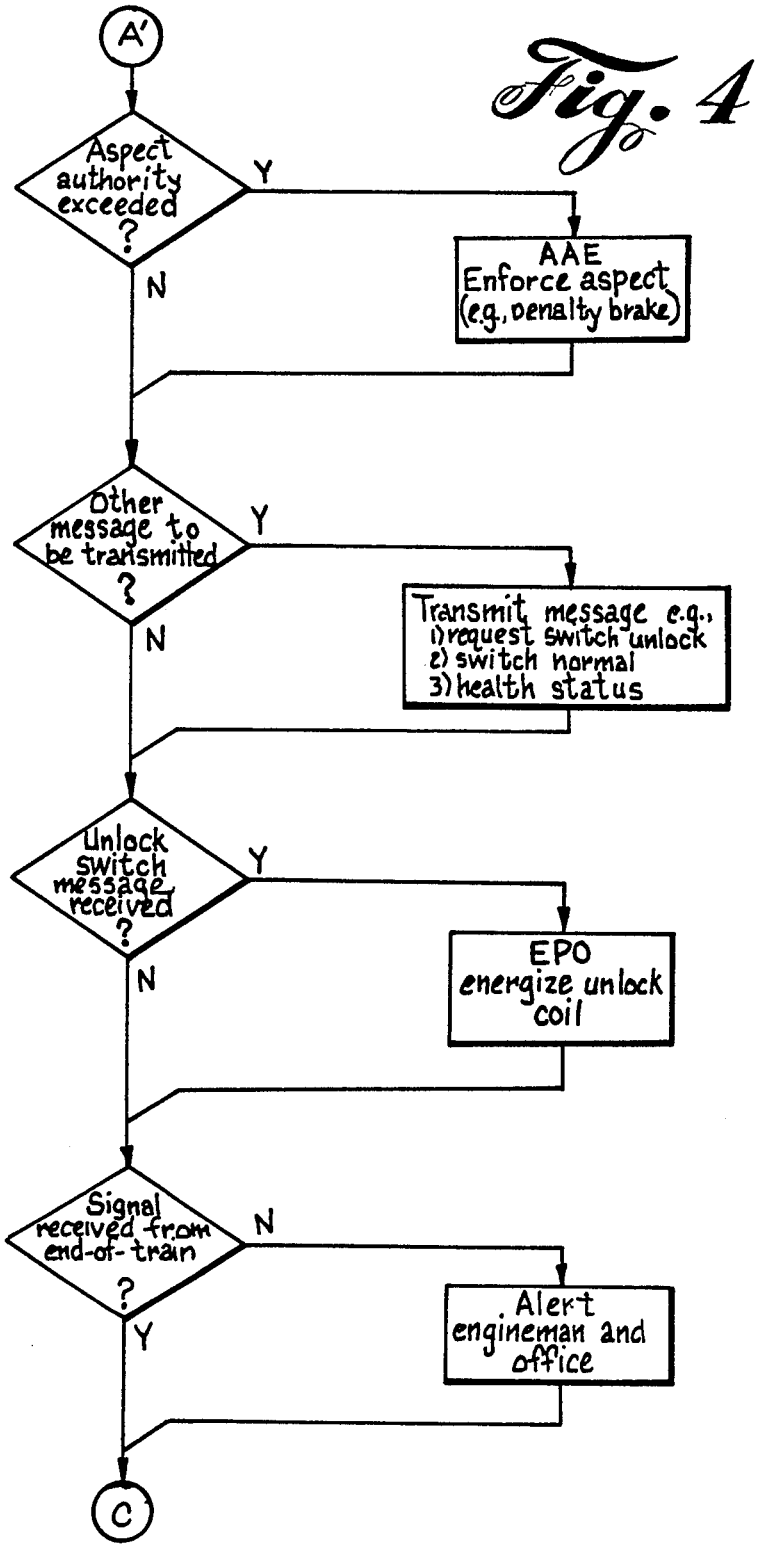

The program starts by examining whether any messages have been received from the central office radio 50. Any such messages are decoded into formats for use in the vital processor. They are also verified utilizing the check bits of the message and acknowledge messages are generated and transmitted over the central office radio 50. A table of data of the trains occupying each of the zones is then developed in the processor's memory. More than one train can be in a zone. The zones can be quite long, especially in territories where railway traffic is light. The messages which are received are then decoded into zone occupied and zone unoccupied messages. The zone occupied messages are transmitted when a train enters a zone and the zone unoccupied messages are transmitted when the train leaves the zone, as was explained in connection with FIG. 3. When a zone occupied message is decoded, the program accesses the occupancy table for the zone in memory. If the zone was previously occupied, the new entering train identification number is added to the zone occupied data table. It is not necessary then to forward a message to the vital logic processor 60 that the zone has been occupied. However, if the train entering the zone is the first train in the zone, a zone occupied message is sent to the vital logic processor. The vital logic processor generates the zone aspect for the next zone ahead. This zone aspect signal is translated into a message with accompanying check bits and is sent via the train radio 50 to the trains.

The data as to the aspects and the occupancy of the zones is sent to the display processor (DP) 62. The display processor then drives the display so that the dispatcher at the central office can observe the location of the trains and the aspect at which they are authorized to proceed.

If the message is a zone unoccupied message, the zone occupied table is then scanned. If the train identified as providing the zone unoccupied message is listed in the zone occupied data table, it is deleted from the table and an output indicating that all trains are out of the zone is transmitted to the vital logic processor.

Other messages are then processed. The next message to be processed is the track switch status message. This message can come from a powered switch machine such as the machine 24 in FIG. 1 or can be a request from the engineer of a train. If such a switch status message is received, the processor 54 repeats the request message to the vital logic processor 60. The vital logic processor then transmits a permission message, if such a message is required. This message may be transmitted directly to a powered switch machine such as the switch machine 24 or may be a permission message. The permission message is displayed on the display 32 of the train equipment and may also be used to energize an inductive loop on the locomotive. This inductive loop is used to transfer energy to a second inductive loop on the wayside allowing an electric switch lock to be energized and the switch points to be moved.

After the switch status messages are processed, any other messages are processed and forwarded to the vital logic processor 60. The aspect data from the vital processor is then examined for any change in any aspect for any train in the territory. If any aspect data is changed, a new aspect message is generated and transmitted via the radio 50 and addressed to the identified locomotive (train). If there are no aspect changes the program proceeds to see if any messages transmitted from the office had not been acknowledged; repeating transmissions when necessary a plurality of times each with a different time delay so as to avoid collisions as was the case with message acknowledgements in the program for the control unit 16 of the train borne equipment. The program then repeats by continuing its loop at C'.

From the foregoing description it will be apparent that there has been provided an improved radio-based railway signaling and traffic control system. A presently preferred embodiment of the system has been described. Variations and modifications thereof, within the scope of the invention, will undoubtedly suggest themselves to those skilled in the art. Accordingly, the foregoing description should be taken as illustrative and not in a limiting sense.

We claim:

1. A railway signaling and traffic control system in which the use of train stop apparatus can be avoided wherein first radio signals are transmitted from trains travelling along tracks and received at a central office and second radio signals are transmitted from the central office to the trains, said system comprising means for transmitting said first signals which represent the locations of each of said trains with respect to boundaries of successive zones along the tracks and identify the train which is transmitting said signals and the zones which the identified trains are entering and leaving, means responsive to said first signals for transmitting to identified trains said second signals which represent a signal aspect for the zone occupied by each of said identified trains and for the next zone, means on each train for displaying the aspect of the zone which it occupies and for storing the aspect for the next zone, means on each train for automatically operating said displaying means for displaying the stored aspect for the next zone ahead when the train enters the next zone, and means for automatically operating said displaying means for displaying in each train a signal aspect for said next zone more restricted than the signal aspect displayed by said displaying means in said train for the preceding occupied zone in the event that the signal aspect for said next zone is not being stored when said train enters said next zone.

2. The system according to claim 1 wherein said first signal transmitting means comprises means in communicating relationship with said trains for indicating the presence of said trains at each of said zone boundaries, and means on each of said trains responsive to the distance it has traveled past each of said zone boundaries and to said presence indicating means for providing a control signal when said distance is greater than the distance between successive zone boundaries.

3. The system according to claim 2 wherein means are provided for operating said aspect displaying means to display an aspect more restrictive than the aspect then displayed thereon when said control signal is provided.

4. The system according to claim 2 wherein said presence indicating means comprises passive transponders disposed at each of said zone boundaries, and means on each of said trains for interrogating said transponders and deriving messages representing the zone boundaries at which said transponders are disposed.

5. The system according to claim 4 wherein said passive transponders each have means for providing said messages including the identification of its respective zone boundary and distance to the next zone boundary, and said distance traveled responsive means being operated by the distance to the next zone boundary information in said messages.

6. The system according to claim 2 wherein said distant traveled responsive means comprises an odometer.

7. The system according to claim 1 wherein said means for transmitting said first signal comprises passive transponders disposed at each of said zone boundaries providing messages identifying the zone boundary at which said transponders are disposed and the distance to the next zone boundary.

8. The system according to claim 1 further comprising means on said train and at said central office for transmitting acknowledgement signals in response to said second and first signals, respectively, and means for transmitting each of said first and second signals a plurality of times when said acknowledgement signals thereto are not received.

9. The system according to claim 1 further comprising means on each of said trains for detecting whether said train is proceeding in excess of the authority represented by the aspect for the zone in which it is traveling, and means operated by said detecting means for automatically controlling said train to enforce the authorized aspect.

10. The system according to claim 9 wherein said means for detecting whether said train is proceeding in excess of its authority comprises an odometer, means responsive to said odometer for detecting the speed of said train, and means for comparing said speed with the speed represented by the aspect authorized for said zone in which said train is traveling.

11. The system according to claim 1 wherein said first signals transmitting means comprises means for transmitting said first signals for each identified train with messages representing the occupancy of each of said zones upon the entry of said identified train therein and with messages representing the departure of said identified train therefrom.

12. The system according to claim 11 wherein said means for transmitting said first signals with messages representing the occupancy and lack of occupancy comprises an odometer, and means for providing an output when said train enters the next zone and said odometer indicates a distance equal to the length of said train.

13. The system according to claim 1 further comprising means for transmitting first further radio signal messages from said trains to said control office representing traffic control functions and conditions, and means for transmitting second further radio signal messages from said central office to said trains respecting traffic control functions.

14. The system according to claim 13 wherein said trains have means for detecting the intact condition thereof for operating said first further signal transmitting means to transmit a message representing the absence of said intact condition.

15. The system according to claim 13 wherein said first further messages are selected from the group consisting of a voice communication request message, an emergency condition message, an unlocked track switch request message, and a track switch condition (normal or reverse position) message.

16. A system according to claim 13 wherein said trains have means for energizing the unlock coil of a track switch when a message representing an unlock track switch request is authorized by the central office.

17. A system according to claim 1 wherein said central office has first means for processing said first signals for deriving data as to the occupancy of said zones and the identity of the train therein, and second means responsive to the data derived by said first means for generating data signals corresponding to the aspects for the trains identified as occupying said zones, said first processing means being responsive to said aspect data for operating said second signal transmitting means to transmit said second signals addressed to identified trains in said zones.

18. The system according to claim 17 wherein said first processing means includes a central processing unit adapted for processing input data represented by said first signals and communicating data represented by said second signals to radio transmitting means at said central office, and said second processing means is a vital data processor.

19. The system according to claim 13 wherein said trains and said central office have means for generating multibit digital words, formatted in accordance with error correcting or detecting codes, and radio means for transmitting said digital words as said first and second signals.

* * * * *

UNITED STATES PATENT AND TRADEMARK OFFICE

CERTIFICATE OF CORRECTION

PATENT NO. : 4,711,418

DATED : December 8, 1987

INVENTOR(S) : John H. Auer, Jr., and William A. Petit

It is certified that error appears in the above-identified patent and that said Letters Patent is hereby corrected as shown below:

Page Title Heading under United States Patent change "Aver, Jr. et al." to --Auer, Jr. et al.--

Title Page after Inventors: change "John H. Aver, Jr." to --John H. Auer, Jr.--

Signed and Sealed this

Thirty-first Day of May, 1988

*Attest:*

*Attesting Officer*

DONALD J. QUIGG

*Commissioner of Patents and Trademarks*